US006408956B1

(12) United States Patent
Morris et al.

(10) Patent No.: US 6,408,956 B1
(45) Date of Patent: Jun. 25, 2002

(54) FEED SYSTEM FOR A ROTARY DRILL TOWER

(75) Inventors: James E. Morris, Dallas; Steven M. Precopia; Gary W. Howell, both of Garland, all of TX (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 09/529,584

(22) PCT Filed: Oct. 14, 1998

(86) PCT No.: PCT/US98/21721

§ 371 (c)(1),
(2), (4) Date: Aug. 14, 2000

(87) PCT Pub. No.: WO99/19593

PCT Pub. Date: Apr. 22, 1999

Related U.S. Application Data

(60) Provisional application No. 60/062,058, filed on Oct. 15, 1997.

(51) Int. Cl.[7] ..... E21B 3/02

(52) U.S. Cl. ..... 175/113; 175/162; 175/203; 173/44

(58) Field of Search ..... 175/113, 122, 175/162, 203; 173/39, 44

(56) References Cited

U.S. PATENT DOCUMENTS 3,718,316 A * 2/1973 Larralde et al.
3,791,628 A * 2/1974 Burns et al.
5,209,302 A * 5/1993 Robichaux et al.

* cited by examiner

*Primary Examiner*—Roger Schoeppel
(74) *Attorney, Agent, or Firm*—Michael Best & Friedrich LLP

(57) ABSTRACT

A power feed system for a rotary drill includes a hollow tubular derrick having a powerhead connected to a flexible cable moved by a double rod hydraulic cylinder assembly. The derrick includes fixed and movable sheaving assemblies. The hydraulic rod assembly, the fixed and movable assemblies operate substantially within the derrick interior. A guide wheel on the movable sheaving contacts the derrick to maintain axial alignment of the hydraulic rods. Pivotable connections between the cable and the movable sheaves automatically adjust for cable fleet angle change, as the movable sheaves travel, maintaining axial alignment of the hydraulic rods and avoiding introducing torque into the cylinder rods.

25 Claims, 5 Drawing Sheets

FEED SYSTEM FOR A ROTARY DRILL TOWER

This application claims the benefit under 35 USC 119(e) of provisional application No. 60/062,058 filed Oct. 15, 1997.

BACKGROUND OF THE INVENTION

This invention relates generally to rotary down the hole drills, and more particularly to towers (also called derricks) and cable feed systems thereon.

In a rotary head drilling system, a rotary powerhead moves up an down the length of a derrick, which supports this mechanism and the associated drill rods or drill pipe. The rotary powerhead applies torque to the drill rods and rotates the drill rods which in turn rotate the drill bit. A hydraulic cylinder or cylinders are mounted to the derrick structure and are retracted or extended moving sheaves or sprockets that are connected to the rotary powerhead by wire rope cables or roller chain.

In a conventional feed system, usually a single cylinder rod is employed, and the cylinder rod is in compression during the pulldown or pullback modes, rather than tension. This leads to rod buckling from compression. A single cylinder rod system may require long strokes, making galling and buckling of the rod a problem. Furthermore, with single rod systems, larger rod bore sizes are required to avoid buckling, resulting in heavy and expensive equipment.

The foregoing illustrates limitations known to exist in present rotary drill feed systems. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a rotary drill rig comprising: a drill platform; a tubular derrick for carrying drill machinery, the derrick supported on the drill platform in a vertical operating position; a rotary powerhead movable back and forth along the derrick for moving and rotating a drill string; a fixed sheave assembly on the derrick for supporting flexible cable thereon; a movable sheave assembly on the derrick for supporting the cable thereon and for moving back and forth along the derrick to move the power head back and forth along the derrick thereby moving a drill string up and down; a double rod, hydraulic cylinder assembly on the derrick for moving the movable sheave assembly back and forth, the cylinder assembly having a first and second piston rod reciprocable within a cylinder casing, the cylinder casing immovably fixed to the derrick, whereby the first and second piston rods are maintained in tension during operation thereof; the cable strung between the movable sheave assembly, the fixed sheave assembly and the powerhead, to provide a movement ratio measured between the power head and the first and second piston rods of at least 3 to 1; and means for supporting the movable sheave assembly on the derrick during movement thereof.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
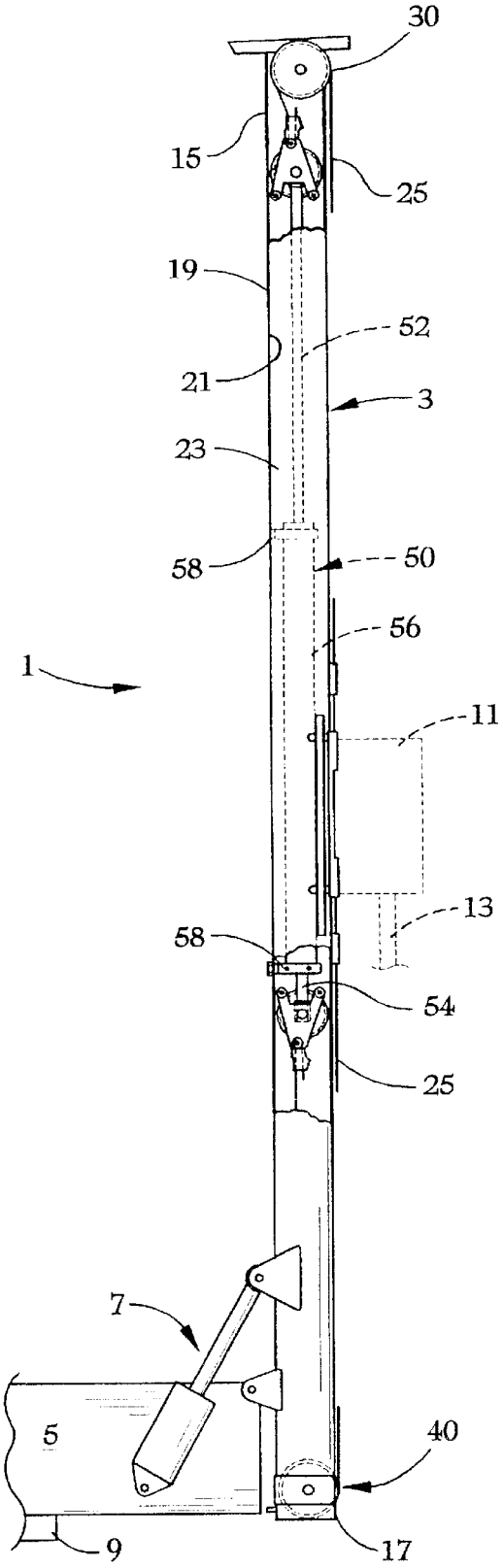
FIG. 1 is a schematic, side elevational view of the drill rig of the invention, with parts removed, showing the derrick in a vertical position on a mobile vehicle.

FIG. 1 is a schematic, side elevational view of the drill rig 1 of the invention, with parts removed, showing the derrick 3 in a vertical position on a drill platform 5. Derrick 3 is pivotable between a horizontal storage and travel position (not shown) and an angled or a vertical operating position, by means of cylinder assembly 7 mounting platform 5 to a mobile vehicle frame 9.

Rotary powerhead 11(shown in dotted lines)moves back and forth along derrick 3, for moving and rotating a drill string 13 (shown in dotted lines), as is conventional.

Derrick 3 is preferably a hollow, elongated tubular member having a top portion 15, a bottom portion 17, a body portion 19 therebetween, body portion 19 having a sidewall with an inner surface 21 encompassing and interior space 23.

Figure 4:
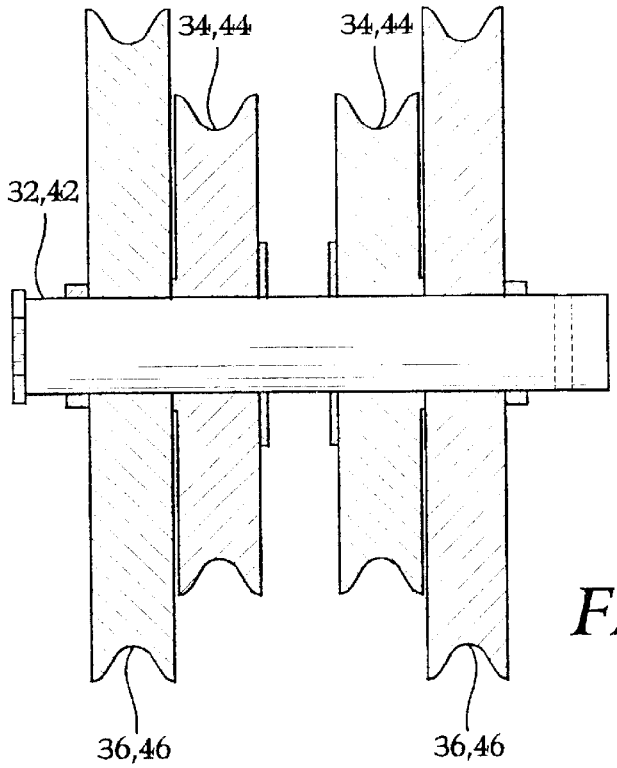
FIG. 4 is a further enlarged, cross-sectional view of a fixed sheave of the invention, with parts removed.

The drill rig 1 further includes fixed sheave assemblies on derrick 3 for supporting flexible cable 25 thereon. The fixed sheave assemblies include a crown sheave 30 positioned on derrick 3 at top portion 15. Crown sheave 30 is rotatable about a first pivot pin 32. Crown sheave 30 carries a pair of grooved wheels 34, 36 of different first and second diameters (FIG. 4). The fixed sheave assemblies also include a bottom sheave 40 positioned on the derrick 3 at bottom portion 17. Bottom sheave 40 is rotatable about a second pivot pin 42. Bottom sheave 40 carries a pair of grooved wheels 44, 46 of different third and fourth diameters, equal to said first and second crown sheave wheel diameters respectively. Bottom sheave 40 and crown sheave 30 are essentially the same, and a description of one suffices for both.

The drill rig 1 further includes a movable sheave assembly on derrick 3 for supporting flexible cable 25 thereon. The movable sheave assembly will be described hereinbelow.

The drill rig 1 further includes a double rod, hydraulic cylinder assembly 50 on derrick 3 for moving the movable sheave assembly back and forth. Cylinder assembly 50 has a first and second piston rod 52, 54 reciprocable within a cylinder casing 56 (FIG. 1). Casing 56 is immovably fixed to said derrick by conventional fastening means 58, whereby said first and second piston rods 52, 54 are maintained in tension during operation thereof.

Figure 2:
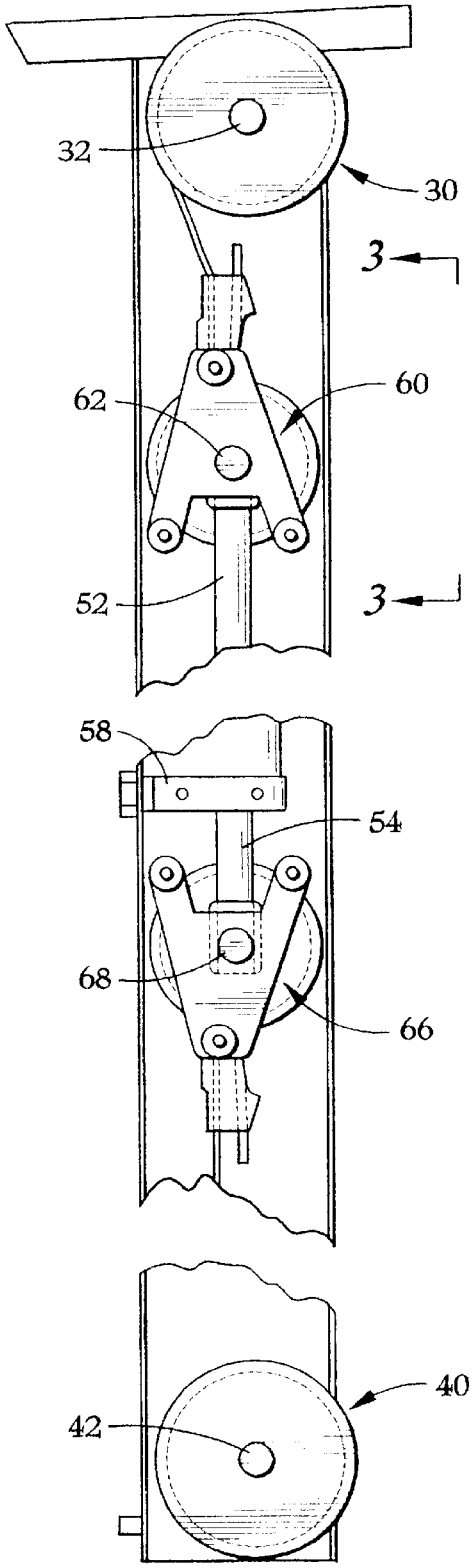
FIG. 2 is a schematic, side elevational enlarged view, of the invention showing the derrick, with parts removed, depicting the fixed and traveling sheaves.
Figure 3:
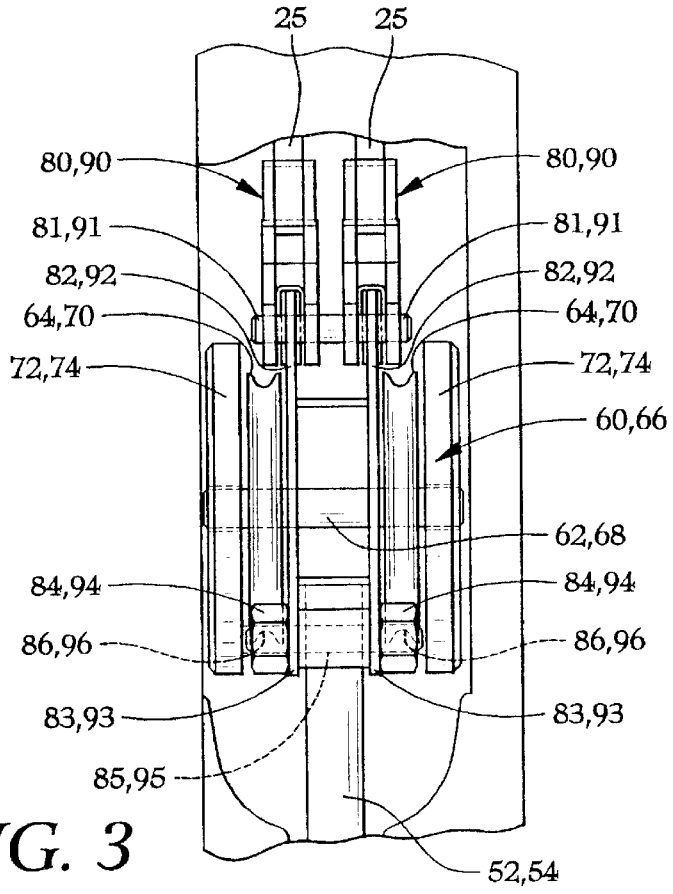
FIG. 3 is a further enlarged view of the traveling sheave along 3—3 of FIG. 2, with parts removed.

Referring to FIGS. 1, 2 and 3, the movable sheave assembly is now described. A first traveling sheave assembly 60 is connected to a distal end of first piston rod 52. Traveling sheave assembly 60 is rotatable about third pivot pin 62. Sheave 60 carries at least one grooved wheel 64 of fifth diameter. As described hereinbelow, for a 3 to 1 mechanical advantage ratio, we prefer two identical wheels 64 on first traveling sheave 60.

A second traveling sheave 66 is connected to a distal end of second piston rod 54. Traveling sheave 66 is rotatable about fourth pivot pin 68. Sheave 66 carries at least one grooved wheel 70 of sixth diameter, equal to fifth diameter of wheel 64 on first traveling sheave 60. For a 3 to 1 mechanical advantage ratio, we prefer two identical wheels 70 on second traveling sheave 66.

Mounted on first traveling sheave 60 is a first traveling roller guide wheel 72. Wheel 72 is rotatable about third pivot pin 62. Wheel 72 moves with sheave 60 and rides along inner surface 23 to help maintain axial alignment of piston rod 52. Mounted on second traveling sheave 66 is a second traveling roller guide wheel 74. Wheel 74 is rotatable about fourth pivot pin 68. Wheel 74 moves with sheave 66 and rides along inner surface 23 to help maintain axial alignment of piston rod 54.

Mounted on first traveling sheave 60 is a first traveling cable anchor assembly 80, rotatable about third pivot pin 62. Cable anchor end 82 connects to an end of cable 25, as is conventional. The cable end is pivotable about fifth pivot pin 81 on anchor end 82. Attached to an anchor end 83 distal from end 82 is a cable guide wheel 84 spaced adjacent to groove 86 of sheave wheel 64 for retaining cable 25 in groove 86, in the event that cable 25 becomes slack. Guide wheel 84 is rotatable about sixth pivot pin 85.

Mounted on second traveling sheave 66 is a second traveling cable anchor assembly 90, rotatable about fourth pivot pin 68. Cable anchor end 92 connects to an end of cable 25, as is conventional. The cable end is pivotable about seventh pivot pin 91 on anchor end 92. Attached to an anchor end 93 distal from end 92 is a cable guide wheel 94 spaced adjacent to groove 96 of sheave wheel 70 for retaining cable 25 in groove 96. Guide wheel 94 is rotatable about eighth pivot pin 95. It can be understood that first and second traveling cable anchor assemblies 80, 90 are the same, except one is oriented "up" toward top 15 of derrick 3 and the other is oriented "down" toward bottom 17 of derrick 3. Therefore, a description of one will suffice for the other.

As shown in FIG. 3, on first traveling sheave 60, we prefer to stack two grooved wheels 64 side by side along third pivot pin 62, with a cable anchor assembly 80 for both wheels 64 positioned between the two wheels 64. Guide wheels 72 are stacked on pivot pin 62 outside of grooved wheels 64. It would be equivalent to use only a single combination of wheel 64, cable anchor assembly 80 and cable 25. A similar stacking arrangement is preferred for second traveling sheave 74 and the description herein suffices for second traveling sheave 74.

Figure 5:
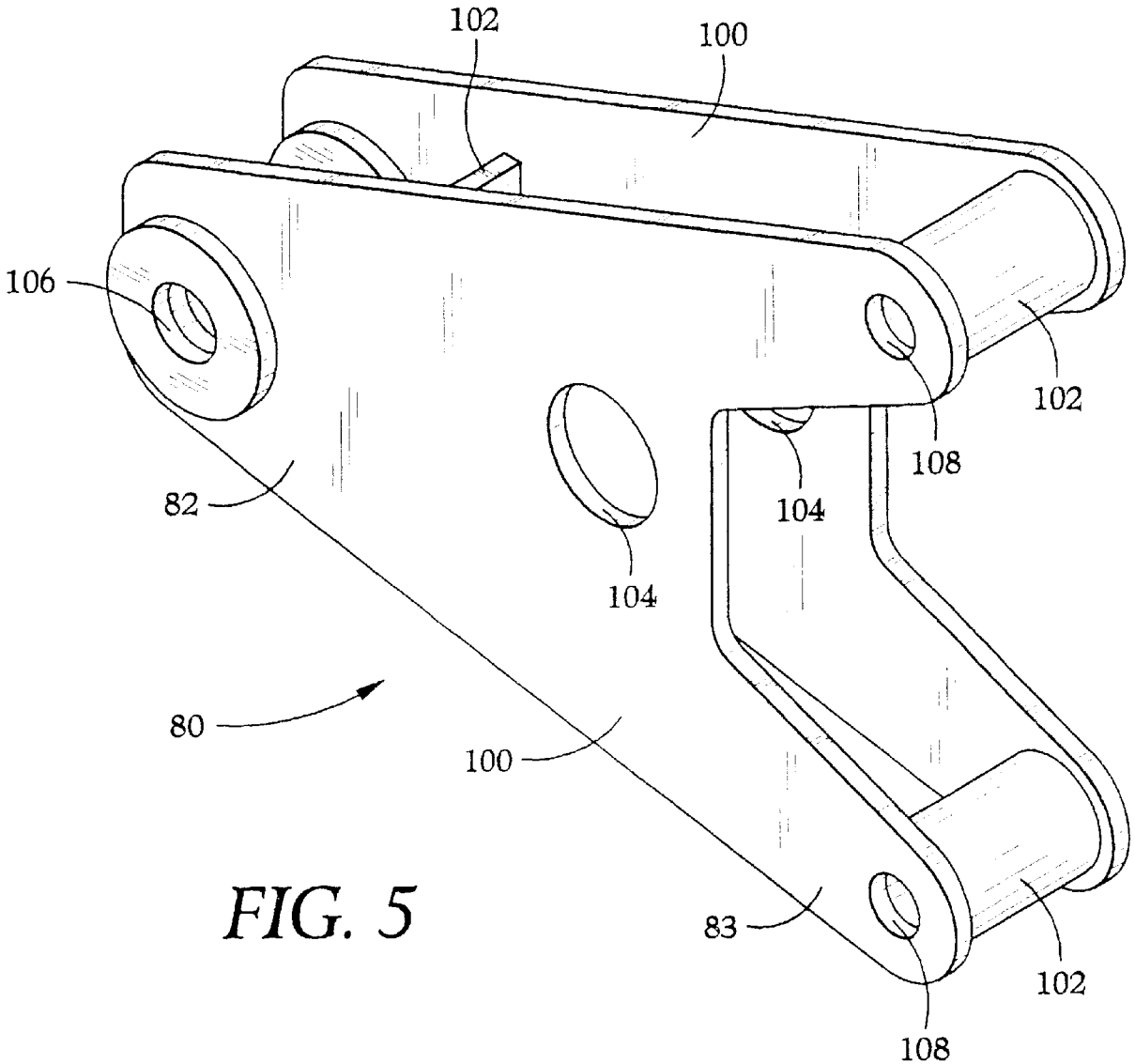
FIG. 5 is a perspective view, with parts removed, of a traveling cable anchor assembly of the invention.
Figure 7:
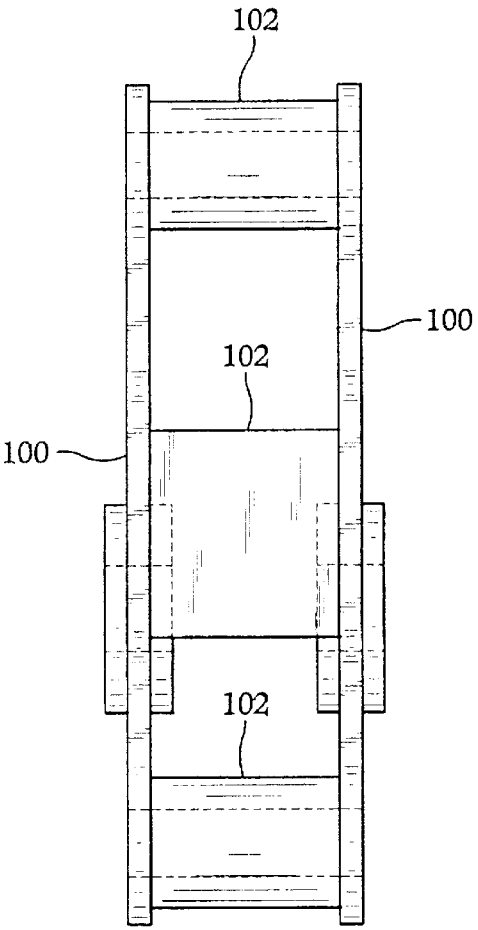
FIG. 7 is a view along 7—7 of FIG. 6.
Figure 6:
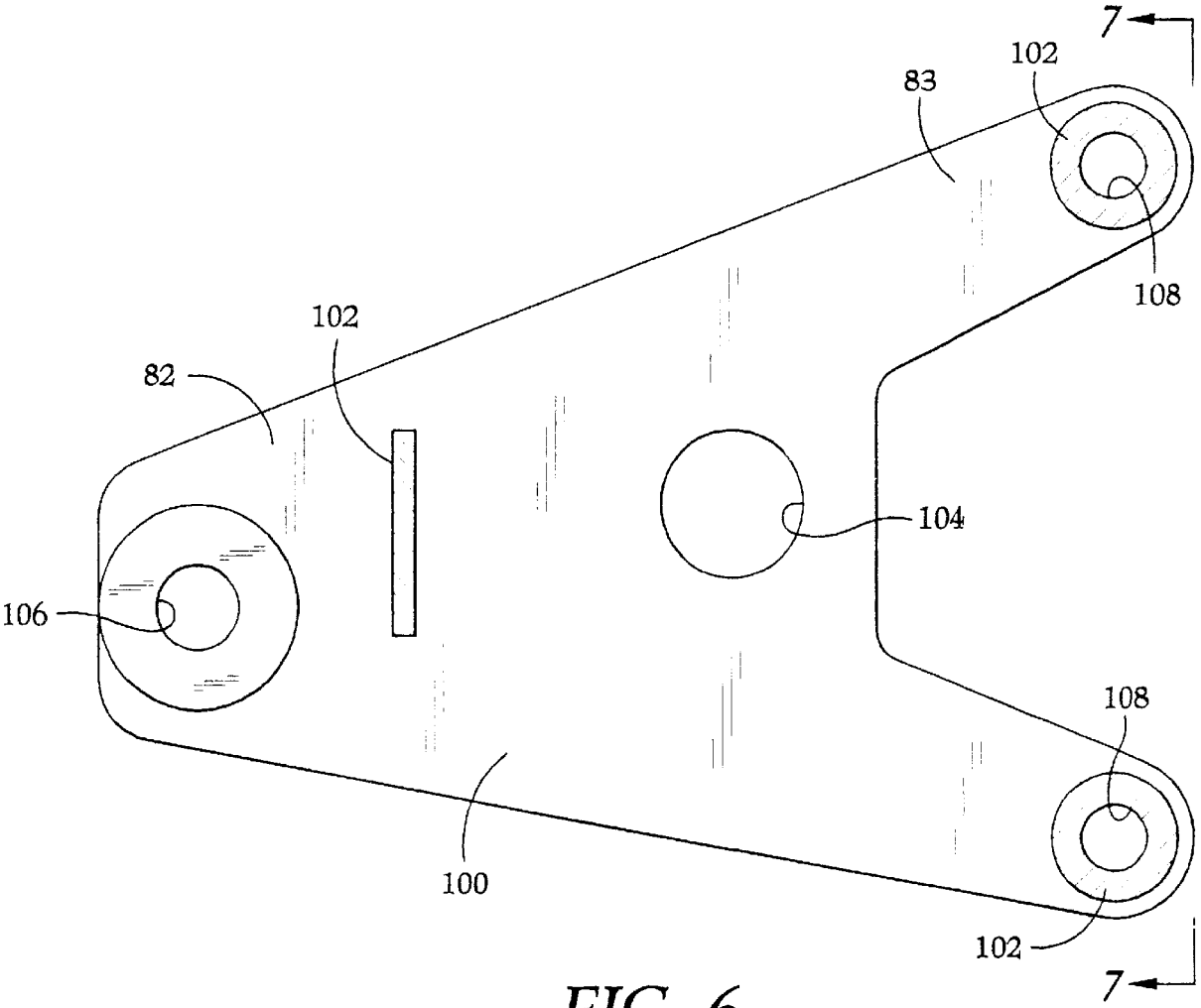
FIG. 6 is a side view, with parts removed, of the cable anchor assembly of FIG. 5.

Since cable anchor assemblies 80 and 90 are the same, a further description of one suffices for both. As shown in FIGS. 5, 6 and 7, cable anchor assembly 80 is formed by a pair of spaced apart side plates 100 rigidly connected together by cross members 102. Apertures 104, 106, and 108 receive pivot pins 62, 81 and 85, respectively.

For crown sheave 30, FIG. 4 shows the preferred stacking arrangement of wheels 34, 36 and pivot pin 32. A similar arrangement is preferred for bottom sheave 40, and the description herein suffices for bottom sheave 40.

As shown in FIGS. 1 and 2, crown sheave 30, bottom sheave 40, cylinder assembly 50 and traveling sheaves 72 and 74 are housed essentially within interior space 23 of derrick 3, thereby protecting the moving components from exposure to the elements and from rod handling operations.

Figure 8:
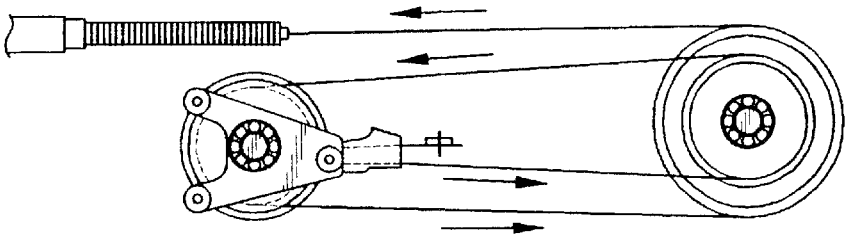
FIG. 8 is a schematic view depicting the cable weaving arrangement of the invention.
Figure 9:
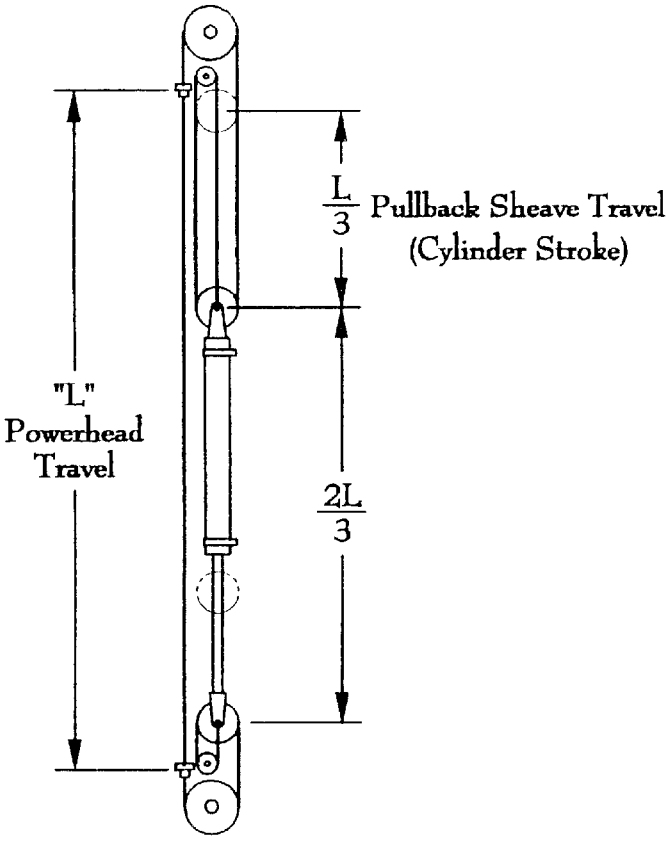
FIG. 9 is a schematic representation of one embodiment of the invention, with parts removed, depicting a 3 to 1 travel ratio between a rotary head and a cylinder rod the invention.
Figure 10:
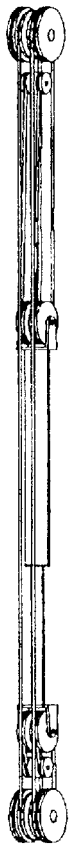
FIG. 10 is a perspective view of FIG. 9.

FIG. 8 is a schematic view depicting the preferred cable weaving arrangement of the invention to provide a 3 to 1 travel ratio advantage between rotary powerhead 11 and piston rods 52, 54. FIGS. 9 and 10 show an alternate embodiment cable weaving arrangement to provide the same 3 to 1 movement ratio advantage, while maintaining piston rods 52, 54 in tension.

Thus, it can be understood that the pivotable connections at pivot pins 62, 68, 81 and 91 maintain proper axial position of rods piston 52, 54, even though the fleet angle of the cable varies with respect to the sheaves, as the position of the traveling sheaves varies, thereby avoiding introducing torque into the rods 52, 54.

As the hydraulic piston imparts tension on rod 52, rod 52 pulls on traveling sheave 60, thus moving feed cable 25 on the grooved wheels 64, 70, 34 and 36, which in turn causes a movement of the powerhead in the opposite direction. Thus, it can be understood that this system allows high powerhead travel speeds at low hydraulic cylinder rod speeds which helps reduce rod galling experienced at higher rod speeds and requires lower hydraulic oil flows to the hydraulic cylinders.

The double rod cylinder allows travel speeds in both directions to be the same. The differential area of a conventional (single rod) hydraulic cylinder and the associated difference in speed and force at fixed flows and fixed pressures is equalized. This also allows for either open loop or high efficiency closed loop hydraulic system applications.

Cable or chain reeving arranged in this manner allows the hydraulic cylinder rod to be in tension in all load conditions. In the pulldown mode the lower rod is in tension. In the pullback mode the upper rod is in tension.

Because the cylinder rod is in tension for both pulldown and pullback modes, rather than compression, as in conventional feed systems, rod buckling from compression is eliminated. Cylinder bore size and rod size may be reduced while producing the same pullback and pulldown forces through the application of high pressure hydraulic oil. This can reduce weight and oil flow volumes which further reduces cost for hydraulic pumps and control valves. Also because the cylinder rods are never in compression and cylinder strokes are short, the very long powerhead travel lengths that are required for single pass operation are possible.

Because the hydraulic cylinders are relatively short in length for a given powerhead travel length, with cylinder strokes of "L/3", where "L" equals powerhead travel length (conventional 2:1 systems require cylinder strokes of "L/2"), manufacturing costs can be reduced significantly.

The ability of this system to use wire rope cables reduces system weight and cost versus chain. This significant weight reduction can allow other components to be reduced in size, weight, and cost.

While we have disclosed the invention using cable, chain and sprocket combinations would work. Also, while the derrick 3 is preferred as a hollow tubular member, a lattice-type derrick would work if provided with tracks for roller guide wheels 72, 74.

Also, while we have disclosed the invention using traveling sheave wheels 64, 70 having one equal diameter, and fixed sheave wheels 34, 36, 44, 46 having two different diameters, it would be equivalent to provide an arrangement having two different diameter wheels on the traveling sheave, with a single diameter size wheel on the fixed sheaves. In that case, the cable would be strung such that the cable end would be pivotably connected at the fixed sheaves and not at the traveling sheaves.

What is claimed is:

1. A rotary drill rig comprising:

(a) a drill platform:

(b) a derrick for carrying drill machinery, said derrick supported on said drill platform;

(c) a rotary powerhead for moving and rotating a drill string;

(d) a fixed pulley assembly on said derrick for supporting a flexible connector thereon;

(e) a movable pulley assembly on said derrick for supporting said flexible connector thereon and for moving back and forth along said derrick to move said rotary powerhead back and forth along said derrick; and (f) a hydraulic cylinder rod assembly on said derrick for moving said movable pulley assembly back and forth, said cylinder assembly having at least one piston rod reciprocable within a cylinder casing, said cylinder casing immovably fixed to said derrick, whereby said piston rods are maintained in tension during operation thereof.

2. The drill rig of claim 1, wherein said hydraulic cylinder rod assembly includes a first and a second piston rod.

3. The drill rig of claim 2, wherein said flexible connector is strung between said movable pulley assembly, said fixed pulley assembly and said rotary powerhead, to provide a movement ratio measured between said rotary powerhead and said first and second piston rods of at least 3 to 1.

4. The drill rig of claim 3, wherein said derrick comprises a hollow tubular member having a top portion, a bottom portion, and a body portion therebetween, said body portion having a sidewall with an inner surface encompassing an interior space.

5. The drill rig of claim 4, wherein said cylinder assembly and said movable pulley assembly are housed substantially within said interior space.

6. The drill rig of claim 4, wherein said fixed pulley assembly comprises:

(i) a crown pulley positioned on said derrick at said top portion, said crown pulley rotatable about a first pivot pin, and (ii) a bottom pulley positioned on said derrick at said bottom portion, said bottom pulley rotatable about a second pivot pin.

7. The drill rig of claim 6, wherein said crown pulley comprises a pair of wheels of different first and second diameters.

8. The drill rig of claim 7, wherein said bottom pulley comprises a pair of wheels of different third and fourth diameters.

9. The drill rig of claim 8, wherein said third and fourth diameters of said bottom pulley are equal to said first and second crown pulley wheel diameters, respectively.

10. The drill rig of claim 4, wherein said movable pulley assembly comprises:

(i) a first traveling pulley connected to a distal end of said first piston rod, said first traveling pulley rotatable about a third pivot pin; and (ii) a second traveling pulley connected to a distal end of said second piston rod, said second traveling pulley rotatable about a fourth pivot pin.

11. The drill rig of claim 10, wherein said first traveling pulley comprises at least one wheel of a fifth diameter.

12. The drill rig of claim 11, wherein said second traveling pulley comprises carrying at least one wheel of a sixth diameter.

13. The drill rig of claim 12, wherein said fifth diameter of said first traveling pulley is equal to said sixth wheel diameter of said second traveling pulley.

14. The drill rig of claim 12 further comprising a first traveling pulley roller guide wheel on said first traveling pulley, rotatable about said third pivot pin, for supporting said first traveling pulley against said inside surface of said tubular derrick during movement of said first traveling pulley.

15. The drill rig of claim 12 further comprising a second traveling pulley roller guide wheel on said second traveling pulley, rotatable about said fourth pivot pin, for supporting said second traveling pulley against said inside surface of said tubular derrick during movement of said second traveling pulley.

16. The drill rig of claim 12 further comprising a first traveling flexible connector anchor assembly connected to said first traveling pulley, said first traveling flexible connector anchor assembly rotatable about said third pivot pin.

17. The drill rig of claim 16 further comprising a second traveling flexible connector anchor assembly connected to said second traveling pulley, said second traveling flexible connector anchor assembly rotatable about said fourth pivot pin.

18. The drill rig of claim 17, wherein said first traveling flexible connector anchor assembly and said second traveling flexible connector anchor assembly each include a first and second anchor end for pivotably connecting to a first and second end, respectively, of said flexible connector.

19. The drill rig of claim 16, wherein said first traveling flexible connector anchor assembly and said second traveling flexible connector anchor assembly each include a guide wheel means attached to an end distal from said first and second flexible connector anchor end, respectively, each said guide wheel being spaced adjacent to a wheel and rotatable about a fifth pivot pin.

20. The drill rig of claim 1 wherein said flexible connector is a cable.

21. The drill rig of claim 1 wherein said flexible connector is a chain.

22. The drill rig of claim 1 wherein said derrick is pivotable between a substantially horizontal storage and travel position and a substantially vertical operating position.

23. The drill rig of claim 1 wherein said drill platform is carried on a mobile vehicle frame.

24. The drill rig of claim 1, wherein said fixed pulley assembly and said movable pulley comprise at least one sheave.

25. The drill rig of claim 1, wherein said fixed pulley assembly and said movable pulley comprise at least one sprocket.

* * * * *